United States Patent [19]

Wang

[11] Patent Number: 4,936,454

[45] Date of Patent: Jun. 26, 1990

[54] PORTABLE FILE CASE

[76] Inventor: Bor-Jou Wang, 3/F No. 740, Ching Chen Road, Yung-Ho Taipei Hsien, Taiwan R.O.C., Taiwan

[21] Appl. No.: 424,626

[22] Filed: Oct. 20, 1989

[51] Int. Cl.[5] ..... B42F 7/08; B65D 85/62; B65D 43/24

[52] U.S. Cl. ..... 206/425; 206/45.13; 220/335; 312/185

[58] Field of Search ..... 206/425, 45.13; 220/324, 326, 335; 312/184, 185

[56] References Cited

U.S. PATENT DOCUMENTS

| | | | |
|---|---|---|---|
| 1,050,409 | 1/1913 | Wadsworth et al. | 312/184 X |
| 2,201,547 | 5/1940 | Scheinman | 206/425 |
| 3,724,920 | 4/1973 | Beck | 206/425 X |
| 4,234,238 | 11/1980 | Figueroa | 312/184 |
| 4,325,595 | 4/1982 | Solomon | 220/335 X |
| 4,505,388 | 3/1985 | Solomon | 206/425 |
| 4,759,443 | 7/1988 | Egly | 206/425 |

*Primary Examiner*—Paul T. Sewell
*Assistant Examiner*—Jacob K. Ackun, Jr.
*Attorney, Agent, or Firm*—Lowe, Price, LeBlanc, Becker & Shur

[57] ABSTRACT

A portable file case includes a expandable front panel which can be alternatively positioned at two predetermined positions to adjust the inner receiving chamber according to the amount files received therein, and comprises internally a range adjustable hanging structure for mounting a variety of hanging files.

3 Claims, 3 Drawing Sheets

PORTABLE FILE CASE

BACKGROUND OF THE INVENTION

Regular file case or file organizer for keeping files in order is normally of fixed type and not movable. If one needs to carry a variety of files with oneself to go to somewhere to make a report, analysis or for some other purposes, one shall have to prepare a suitcase or container or a file cases to hold the files. However, regular suitcase or container is not practical for keeping files in order or for convenient arrangement of the files received therein. Although conventional file case is convenient for receiving files, it simply comprises some compartments for classification of files received therein or a fixed hanging structure for mounting fixed size of hanging files. If too much files are received in a file case, it will be very difficult to make a search for a specific one.

It is therefore, the main object of the present invention is to provide such a portable file case which is convenient for arranging files.

Another object of the present invention is to provide such a portable file case which includes an expandable compartment lining structure and a position adjustable front panel to flexibly adjust the inner receiving space according to the amount of files to mount.

A further object of the present invention is to provide such a portable file case which includes internally an adjustable hanging structure for mounting a variety of hanging files.

SUMMARY OF THE INVENTION

The present invention is to provide a portable file case and more particularly to the one which includes a casing having connected thereto a position adjustable front panel at the front, a pivotable cover on the top. The front panel is pivotably connected to the casing and alternatively positioned at either one of predetermined positions according to the amount of files received therein. A range adjustable hanging structure is internally mounted on the two side wall portions of the casing for mounting a variety of hanging files.

| DESCRIPTION OF DESIGNATED NUMERALS: | |
|---|---|
| (1) Cover | (11) Knob |
| (12) Handle | (13) Recess |
| (14) Male fastening element | (15) Side wall |

-continued

| DESCRIPTION OF DESIGNATED NUMERALS: | |
|---|---|
| (2) Casing | (21) Left panel |
| (211) Left protective board | |
| (221) Right Protective board | |
| (23) Gap | (24) Stop block |
| (25) Vertrcal groove | (251) Rail |
| (26) Pivot hole | (3) Front panel |
| (31) Side wall | |
| (32) Female fastening element | |
| (321) Back Panel | (33) Projecting portion |
| (34) Pin | (35) Pin |
| (36) Pin | (37) Knob |
| (4) Channel plate | (41) Side wall portion |
| (411) First channel | (42) Side wall portion |
| (421) Second channel | (43) Middle rail portion |
| (431) Third channel | |
| (5) Expandable compartment lining structure | |
| (51) compartment | |
| (6) Hanging file | (61) Hook end |

Figure 2:
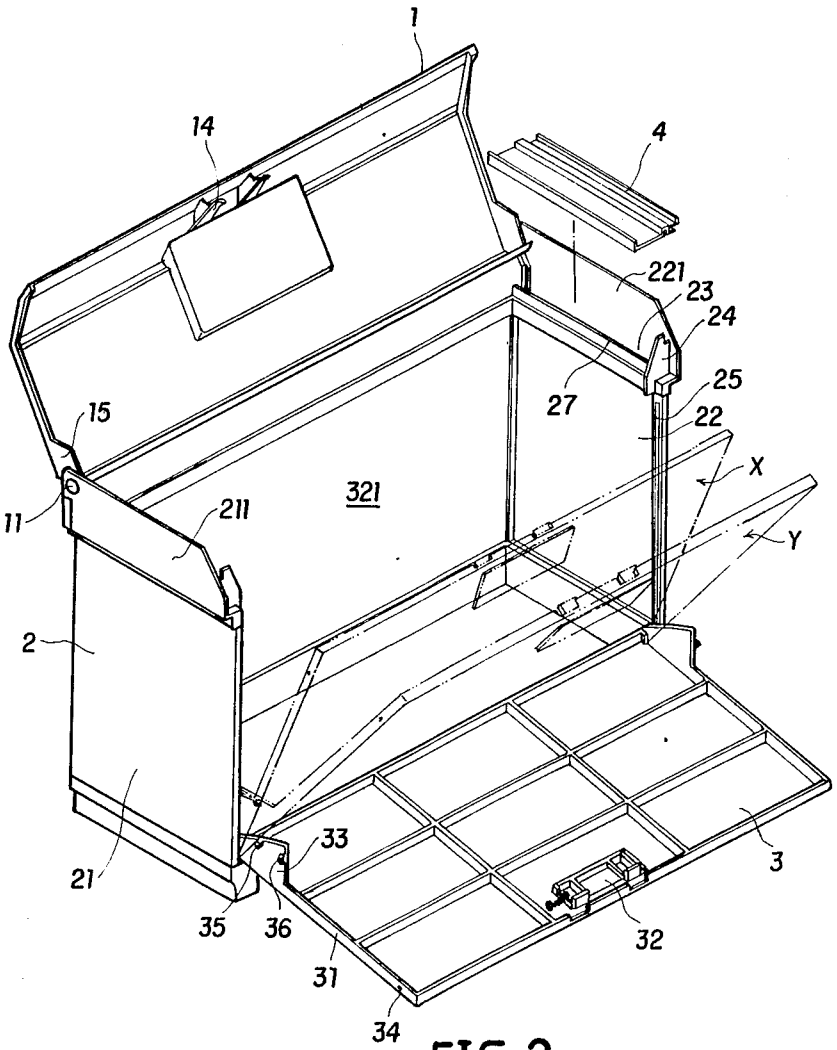
FIG. 2 is schematic drawing illustrating the alternative positioning of the front panel.
Figure 1:
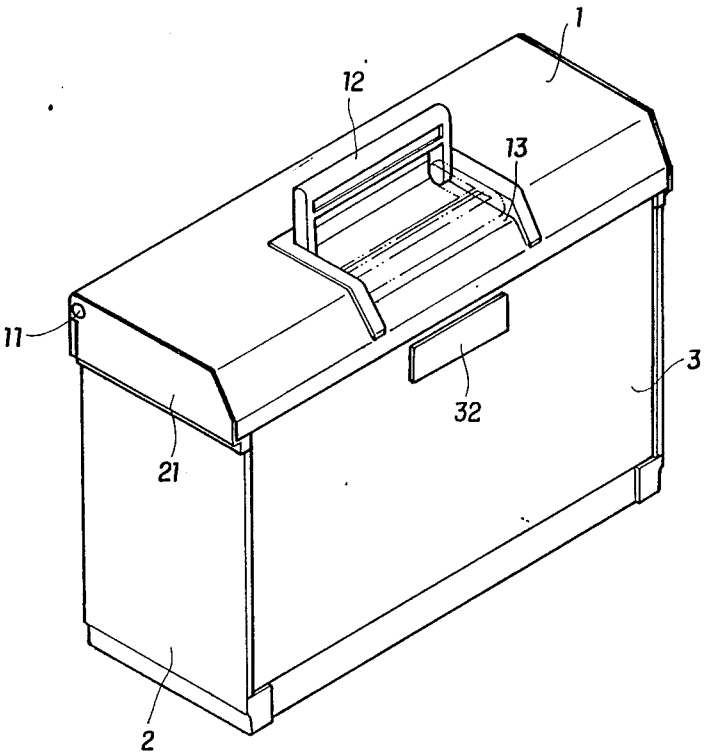
FIG. 1 is a perspective view of a portable file case embodying the present invention.

DETAILED DESCRIPTION OF THE PREFERRED EMBODIMENTS:

Turning now to the annexed drawings in detail, therein illustrated is a portable file case embodying the present invention, made of elastic plastic material and generally comprised a casing (2), a cover (1) and a front panel (3). As illustrated in FIGS. 1 and 2, the cover (1) includes a male fastening element (14) internally at the front end for connection with a female fastening element (32) mounted on the front panel (3) at the top, and a pair of vertical side-walls (15) at both lateral sides having a pair of knobs (11) raised therefrom for pivot connection with a pair of protective boards (211) and (221) which are respectively mounted on the left panel (21) and the right panel (22) of the casing (2) at the top. The front panel 3 includes a pair of vertical side walls (31) bilaterally disposed at the bottom, which vertical side walls (31) comprise a pair of projecting portions (33) having made thereon a pair of knobs (37) (see FIGS. 5 and 6) respectively inserted into the two pivot holes (26) of the left and right panels (21) and (22) at the front bottom end permitting pivoting of the front panel (3) against the casing (2).

Figure 3:
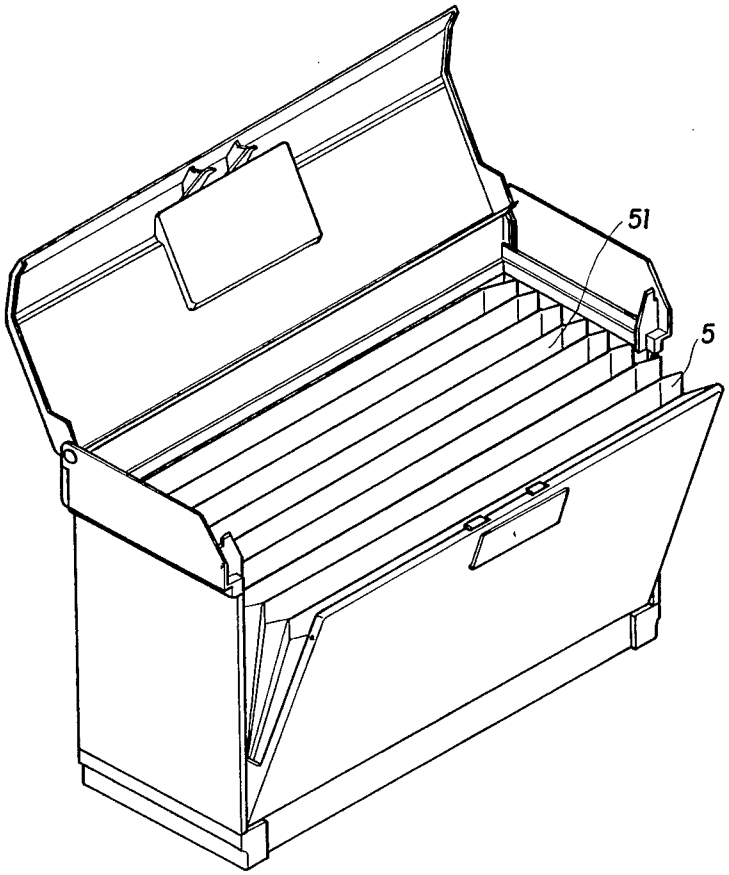
FIG. 3 illustrates a portable file case constructed according to the present invention, in which an expandable compartment lining structure is utilized.

Referring to FIG. 3, an expandable lining structure (5) which defines therein a plurality of compartments (51) for receiving files is set in the casing (2) and attached to the back side of the front panel 3 at the front and to the back panel (321) of the casing (2) at the back. According to the present invention, the connection of the expandable lining structure (5) with the front and back panels (3) and (321) is made by utilizing Velcro strips. Because the front panel (3) is pivotable against the casing (2), the expandable lining structure (5) can be expanded out of the casing 3 for convenient arrangement of files in the compartments (51).

Figure 5:
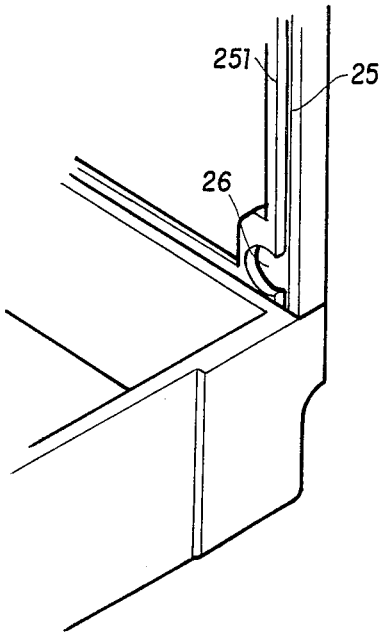
FIG. 5 illustrates the structure of the pivot hole, the vertical groove and the vertical rail of one of the two side panels of the casing.
Figure 6:
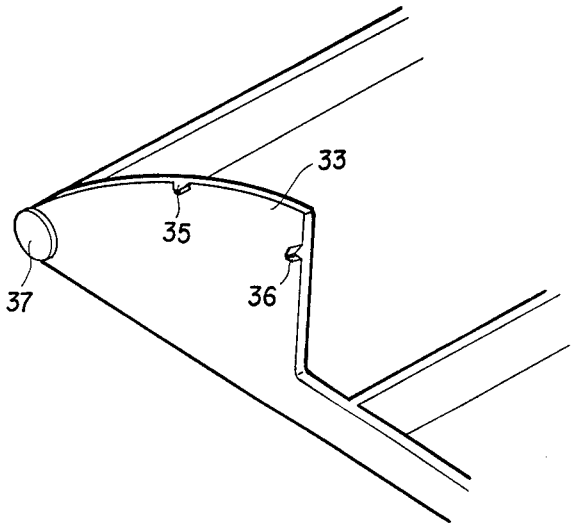
FIG. 6 illustrates the structure of the projecting portion of one side wall of the front panel.

In order to flexibly control the expansion range of the expandable compartment lining structure 5, certain measure must be made. As shown in FIGS. 5 and 6, two pins each (35, 36) are made on the projecting portion (33) of every vertical side wall (31) of the front panel (3), and a pair of elongated vertical grooves (25) are respectively made on the left and right panels (21) and (22) at the front end, i.e. a pair of rails (251) are respectively made on the left and right panels (21) and (22) vertically at the front defining therein a pair of elongated grooves (25) respectively communicating with the pair of pivot holes (26). Therefore, the front panel (3), as illustrated in FIG. 2, can be alternatively positioned at position X or position Y by inserting pin (35) or (36) into vertical groove (25). Under normal condition, the bilateral two pins (36) may be respectively stopped at the inner side of the rails (251). The pins (35) or (36) may be set in the bilateral vertical grooves (25) permitting firmly positioning of the front panel (3) at position X or Y to make more room for the expandable compartment lining structure (5). Because the portable file case of the present invention is made of elastic resilient plastic material, the left and right panels (21) and (22) can be flexibly bent outward into curved shape to extend the range therebetween so as to facilitate inserting the pins (35) or (36) into the bilateral vertical grooves (25). When the bilateral two pins (35) of the front panel (3) are respectively set in the bilateral two vertical grooves (25) of the left and right panels (21) and (22), the expandable compartment lining structure (5) can be expanded to maximum extent for receiving more files or documents.

The front panel (3) further comprises another pair of pins (34) made on the pair of side walls (31) at the top end. The size of the pins (34) is relatively smaller than the pins (35) and (36). When the pins (34) are respectively set in the bilateral two vertical grooves (25) of the left and right panels (21) and (22), the front panel (3) becomes closely attached to the casing (2) to block up the front opening. Because the size of the pins (34) are smaller, if much files or documents are placed in the compartments (51) of the expandable compartment lining structure (5), the pins (34) will be forced to disengage from the bilateral two vertical grooves (25) and the front panel (3) will be allowed to automatically extend outward to become at position X (because the bilateral two pins (36) will be stopped at the bilateral two rails (251)).

Figure 4:
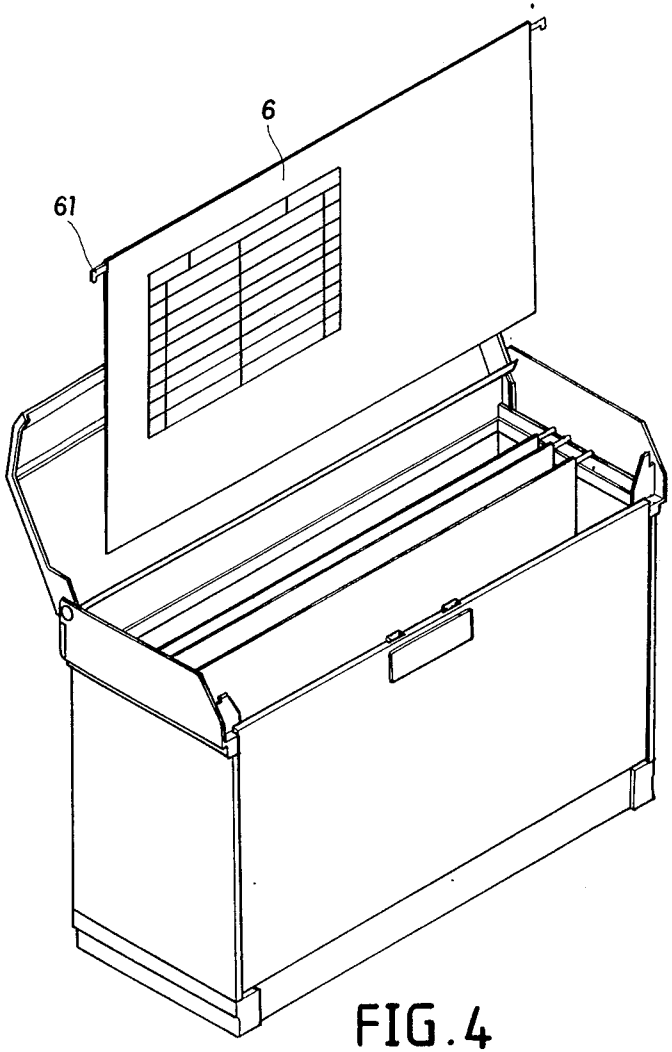
FIG. 4 illustrates a portable file case constructed according to the present invention, in which a hanging file mounting structure is utilized.
Figure 7A:
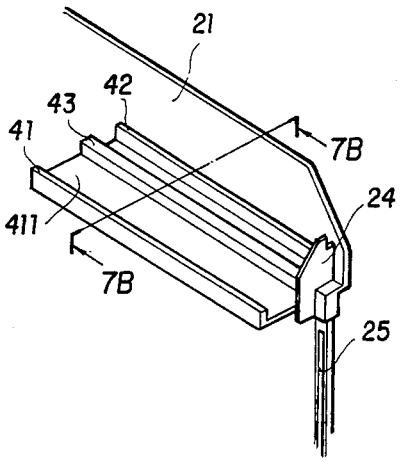
FIG. 7 illustrates the structure and the positioning of a channel plate on a hanging rod.
Figure 7B:
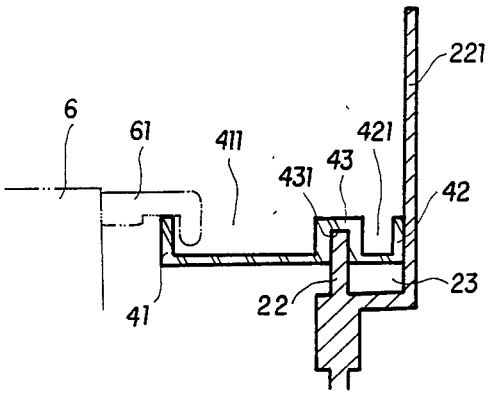

As an alternate form, the expandable compartment lining structure (5) may be removed from the casing (2) to make room for hanging files (6). As illustrated in FIGS. 2 and 4, two hanging rods (27) are mounted on the protective boards (211) and (221) of the left and right panels (21) and (22) at the inner side with gaps (23) left between the hanging rods (27) and the protective boards (211) and (221) for mounting hanging files (6) through respective hook ends (61). A pair of stop blocks (24) are bilaterally set at the front of the pair of hanging rods (27) to limit the forward moving range of hanging files (6) on the hanging rods (27). Because the range between the bilateral two hanging rods (27) is not changeable, hanging files of different size can not be mounted. In order to improve the applicability, one or two channel plates (4) may be mounted on either one or both of the two hanging rods (27) to adjust the range between the two hanging rods (27). As illustrated in FIG. 7, a channel plate (4) of the present invention comprises two side wall portions (41) and (42) and a middle rail portion (43) defining therein a first channel (411) and a second channel (421) on the top and a third channel (431) on the bottom. During assembly to mount a channel plate (4) on the hanging rod (27) of either one of the protective boards (211) and (221), the hanging rod (27) is seated in the third channel (431) and the second channel (421) is disposed between the hanging rod (27) and the protective board (211) or (221). Thus, a hanging file (6) can have its hook end (61) hanging on the side wall portion (41) of the first channel (411).

I claim:

1. A portable file case made of elastic resilient plastic material, including:

a casing comprised of a pair of side panels, a back panel and a front panel, said side panels being symmetrical and each comprising a vertical groove and a pivot hole internally at the front side, said front panel comprising a pair of side walls, said side walls each comprising a projecting portion having made thereon a knob at a lower position, a first pin at a middle position and a second pin at a upper position;

a cover mounted on said casing at the top;

a pair of protective boards respectively mounted on said pair of side panels at the top, each comprising a hanging rod parallely disposed at the inner side with a gap left therebetween for hanging of hanging file; and a channel plate alternatively mounted on either on or both of said pair of protective boards to adjust the range between the two hanging rods of said pair of protective boards for mounting hanging files of different size;

wherein the knobs of the two projecting portions of the two side walls of said front panel are respectively set in the two pivot holes of said pair of side panels permitting pivotal motion of said front panel against said casing, and the two first pins and the two second pins of the two projecting portions of the two side walls of said front panel may be alternatively inserted in the two vertical grooves of said pair of side panels for flexible positioning of said front panel.

2. The portable file case of claim 1, wherein the front panel comprises another pair of pins made on its two side walls at the top end, in size relatively smaller than the pins on the projecting portions.

3. The portable file case of claim 1, wherein the channel plate comprises two side wall portions and a middle rail portion defining therein a first channel and a second channel on the top and a third channel on the bottom, said second channel being made in size suitable for receiving in the gap between the hanging rods and the protective boards.

* * * * *